US005897816A

United States Patent [19]

Johnson

[11] Patent Number: 5,897,816

[45] Date of Patent: Apr. 27, 1999

[54] CONCRETE CORNER FORM

[76] Inventor: James Johnson, Rt 1 Box 181, Marietta, Miss. 38856

[21] Appl. No.: 08/870,037

[22] Filed: Jun. 5, 1997

[51] Int. Cl.[6] ..... E04G 17/14; E04G 21/12

[52] U.S. Cl. ..... 264/35; 33/404; 249/194; 249/219.1; 264/275; 264/279

[58] Field of Search ..... 249/194, 219.1; 52/272, 275, 285.1, 426, 745.1, 745.13; 33/194, 404, 405, 407, 475, 476, 481, 534, 535, 537, 474; 264/35, 261, 259, 271.1, 275, 279

[56] References Cited

U.S. PATENT DOCUMENTS

| | | | |
|---|---|---|---|
| 1,097,393 | 5/1914 | Criswell | 33/481 |
| 3,662,985 | 5/1972 | Parker | 249/194 |
| 4,357,755 | 11/1982 | Allen et al. | 33/518 |
| 5,562,272 | 10/1996 | McAbee et al. | 249/194 |
| 5,658,483 | 8/1997 | Boeshart | 249/194 |

FOREIGN PATENT DOCUMENTS

| | | | |
|---|---|---|---|
| 1265337 | 5/1961 | France | 249/194 |

*Primary Examiner*—Michael Safavi

[57] ABSTRACT

A new Concrete Corner Form for expediting the process of laying out and setting up concrete forms. The inventive device includes a pair of corner support wall members integrally joined at one end and orthogonally oriented relative to one another, and a pair of cross braces each fixedly mounted to a bottom edge of each of the pair of corner support wall members and diagonally oriented thereto. Each of the pair of cross braces extend beyond the pair of corner support wall members so as to form a ledge for supporting a concrete form placed against one of the pair of corner support wall members. Each of the pair of corner support wall members has a plurality of holes therethrough for receiving fasteners. As such, a concrete form placed against one of the pair of corner support wall members is secured thereto by a fastener driven through one of the plurality of holes and into the concrete form.

11 Claims, 2 Drawing Sheets

CONCRETE CORNER FORM

BACKGROUND OF THE INVENTION

1. Field of the Invention

The present invention relates to corner braces and more particularly pertains to a new Concrete Corner Form for expediting the process of laying out and setting up concrete forms.

2. Description of the Prior Art

The use of corner braces is known in the prior art. More specifically, corner braces heretofore devised and utilized are known to consist basically of familiar, expected and obvious structural configurations, notwithstanding the myriad of designs encompassed by the crowded prior art which have been developed for the fulfillment of countless objectives and requirements.

Known prior art corner braces include U.S. Pat. No. 5,207,931; U.S. Pat. No. 5,048,781; U.S. Pat. No. 5,170,977; U.S. Pat. No. D307,078; U.S. Pat. No. 4,048,770; and U.S. Pat. No. 5,425,520.

While these devices fulfill their respective, particular objectives and requirements, the aforementioned patents do not disclose a new Concrete Corner Form. The inventive device includes a pair of corner support wall members integrally joined at one end and orthogonally oriented relative to one another, and a pair of cross braces each fixedly mounted to a bottom edge of each of the pair of corner support wall members and diagonally oriented thereto. Each of the pair of cross braces extend beyond the pair of corner support wall members so as to form a ledge for supporting a concrete form placed against one of the pair of corner support wall members. Each of the pair of corner support wall members has a plurality of holes therethrough for receiving fasteners. As such, a concrete form placed against one of the pair of corner support wall members is secured thereto by a fastener driven through one of the plurality of holes and into the concrete form.

In these respects, the Concrete Corner Form according to the present invention substantially departs from the conventional concepts and designs of the prior art, and in so doing provides an apparatus primarily developed for the purpose of expediting the process of laying out and setting up concrete forms.

SUMMARY OF THE INVENTION

In view of the foregoing disadvantages inherent in the known types of corner braces now present in the prior art, the present invention provides a new Concrete Corner Form construction wherein the same can be utilized for expediting the process of laying out and setting up concrete forms.

The general purpose of the present invention, which will be described subsequently in greater detail, is to provide a new Concrete Corner Form apparatus and method which has many of the advantages of the corner braces mentioned heretofore and many novel features that result in a new Concrete Corner Form which is not anticipated, rendered obvious, suggested, or even implied by any of the prior art corner braces, either alone or in any combination thereof.

To attain this, the present invention generally comprises a pair of corner support wall members integrally joined at one end and orthogonally oriented relative to one another, and a pair of cross braces each fixedly mounted to a bottom edge of each of the pair of corner support wall members and diagonally oriented thereto. Each of the pair of cross braces extend beyond the pair of corner support wall members so as to form a ledge for supporting a concrete form placed against one of the pair of corner support wall members. Each of the pair of corner support wall members has a plurality of holes therethrough for receiving fasteners. As such, a concrete form placed against one of the pair of corner support wall members is secured thereto by a fastener driven through one of the plurality of holes and into the concrete form.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Concrete Corner Form apparatus and method which has many of the advantages of the corner braces mentioned heretofore and many novel features that result in a new Concrete Corner Form which is not anticipated, rendered obvious, suggested, or even implied by any of the prior art corner braces, either alone or in any combination thereof.

It is another object of the present invention to provide a new Concrete Corner Form which may be easily and efficiently manufactured and marketed.

It is a further object of the present invention to provide a new Concrete Corner Form which is of a durable and reliable construction.

An even further object of the present invention is to provide a new Concrete Corner Form which is susceptible of a low cost of manufacture with regard to both materials and labor, and which accordingly is then susceptible of low prices of sale to the consuming public, thereby making such Concrete Corner Form economically available to the buying public.

Still yet another object of the present invention is to provide a new Concrete Corner Form which provides in the apparatuses and methods of the prior art some of the advantages thereof, while simultaneously overcoming some of the disadvantages normally associated therewith.

Still another object of the present invention is to provide a new Concrete Corner Form for expediting the process of laying out and setting up concrete forms.

Yet another object of the present invention is to provide a new Concrete Corner Form which includes a pair of corner support wall members integrally joined at one end and orthogonally oriented relative to one another, and a pair of cross braces each fixedly mounted to a bottom edge of each of the pair of corner support wall members and diagonally oriented thereto. Each of the pair of cross braces extend beyond the pair of corner support wall members so as to form a ledge for supporting a concrete form placed against one of the pair of corner support wall members. Each of the pair of corner support wall members has a plurality of holes therethrough for receiving fasteners. As such, a concrete form placed against one of the pair of corner support wall members is secured thereto by a fastener driven through one of the plurality of holes and into the concrete form.

Still yet another object of the present invention is to provide a new Concrete Corner Form that improves the squareness of concrete forms while also strengthen the concrete forms and bracing the corners thereof. Commonly, wood forms are used in the setting of concrete wherein the wood forms are typically nailed together to create corner forms. As such, it is often difficult to create a square corner. Accordingly, it is an object of the present invention to provide a corner form that ensures a square corner when pouring concrete.

Even still another object of the present invention is to provide a new Concrete Corner Form that provides an improved system for erecting concrete forms and reduces the need for batter boards. Moreover, a system that enables a single person to lay out and set up concrete forms.

Even still another object of the present invention is to provide a new Concrete Corner Form that functions as a corner brace for a concrete slab.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
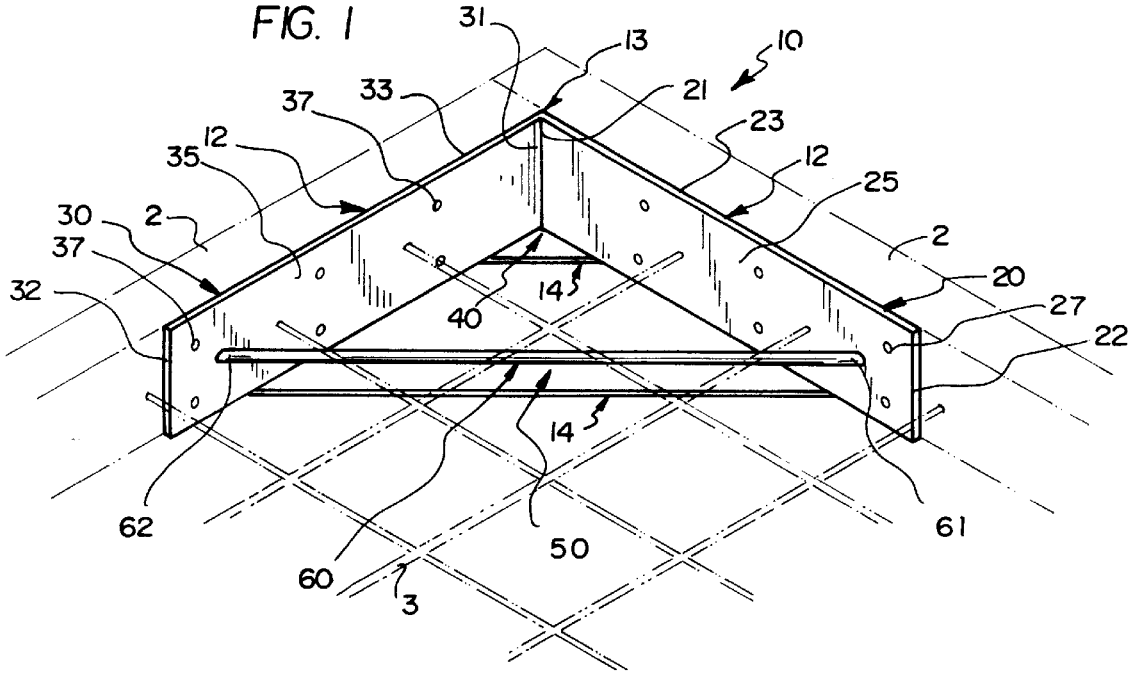
FIG. 1 is an perspective view of a new Concrete Corner Form according to the present invention.
Figure 2:
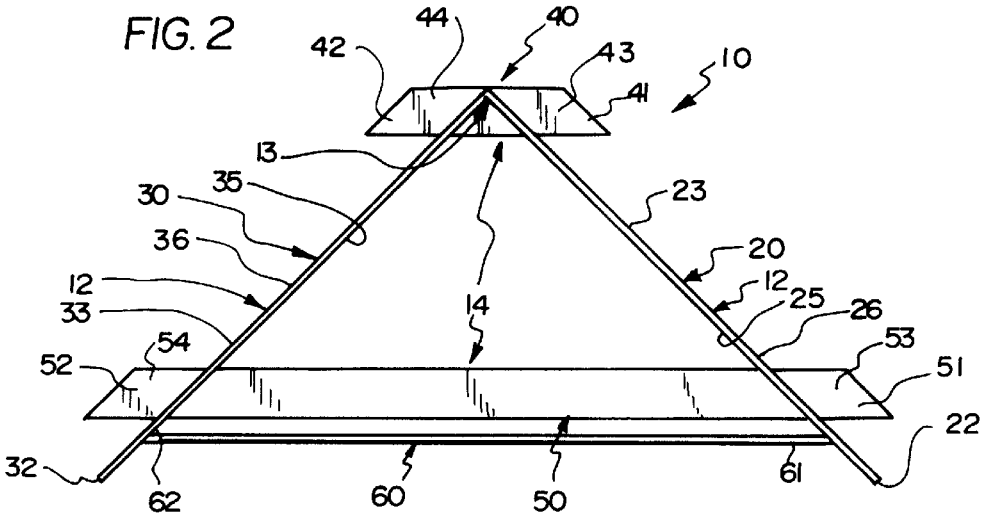
FIG. 2 is a top view of the present invention.
Figure 3:
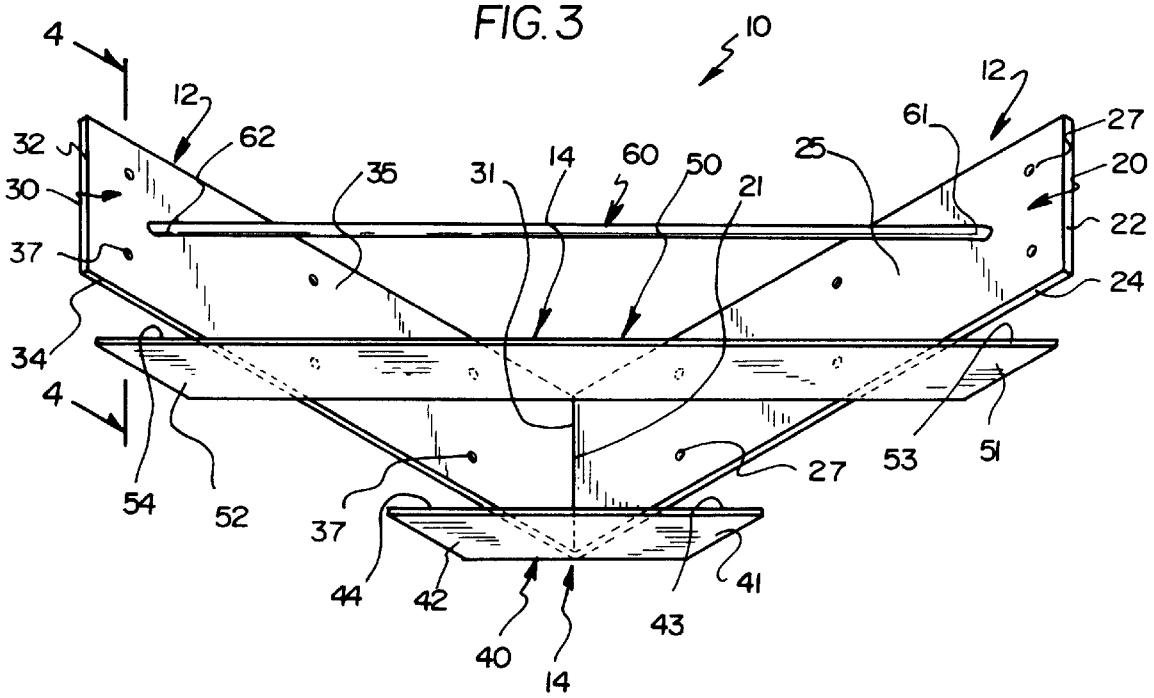
FIG. 3 is a bottom perspective view of the present invention.
Figure 4:
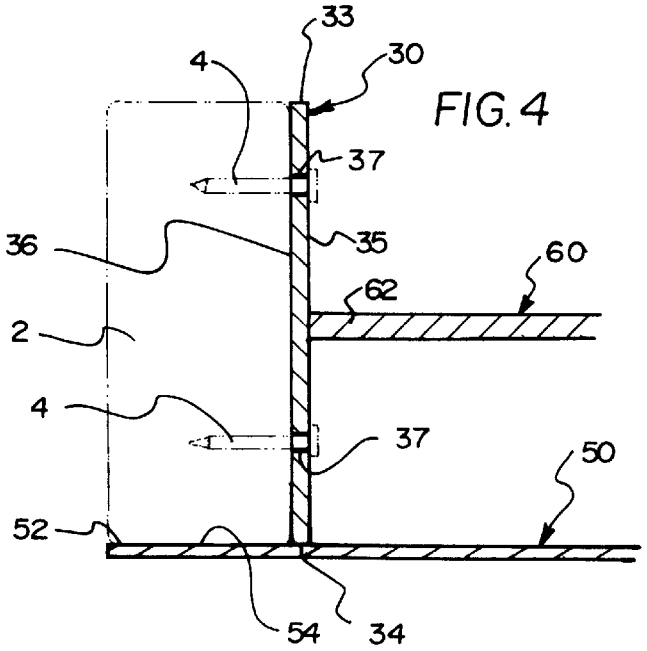
FIG. 4 is a cross sectional view taken along line 4—4 of FIG. 3.

With reference now to the drawings, and in particular to FIGS. 1 through 4 thereof, a new Concrete Corner Form embodying the principles and concepts of the present invention and generally designated by the reference numeral 10 will be described.

More specifically, it will be noted that the Concrete Corner Form 10 comprises a pair of corner support wall members 12 integrally joined at one end and orthogonally oriented relative to one another, and a pair of cross braces 14 each fixedly mounted to a bottom edge of each of the pair of corner support wall members 12 and diagonally oriented thereto. Each of the pair of cross braces 14 extend beyond the pair of corner support wall members 12 so as to form ledges 43, 44, 53, and 54 for supporting a concrete form 2 placed against one of the pair of corner support wall members 12. Each of the pair of corner support wall members 12 has a plurality of holes 27 and 28 therethrough for receiving fasteners 4. As such, a concrete form 2 placed against one of the pair of corner support wall members 12 is secured thereto by a fastener 4 driven through one of the plurality of holes 27 and 28 and into the concrete form 2.

The Concrete Corner Form 10 is intended for use in the setting of concrete, and more specifically, the laying out and setting up of concrete forms 2. Concrete forms 2 commonly consist of 2"×4", 2"×6", 2"×8" or similarly dimensioned lumber. In addition, wire mesh screen 3 is commonly embedded within concrete so as to strengthen the concrete.

As best illustrated in FIGS. 1 through 4, it can be shown that the pair of corner support wall members 12 comprises a first wall member 20 and a second wall member 30. The first wall member 20 and the second wall member 30 each have a corner edge 21 and 31, respectively, an outer edge 22 and 32, respectively, a top edge 23 and 33, respectively, and a bottom edge 24 and 34, respectively. The corner edge 21 of the first wall member 20 and the corner edge 31 of the second wall member 30 are integrally joined to form a corner junction 13, wherein the first wall member 20 is orthogonally oriented relative to the second wall member 30. The first wall member 20 and the second wall member 30 each have an inner surface 25 and 35, respectively, and an outer surface 26 and 36, respectively, and have a plurality of holes 27 and 37, respectively, therethrough. The plurality of holes 27 and 37 are adapted for receiving fasteners 4, and more specifically nails, for securing a concrete form 2 to at least one of the first wall member 20 and the second wall member 30.

The pair of cross braces 14 comprises a first brace 40 and a second brace 50. The first brace 40 and the second brace 50 each have a first end 41 and 51, respectively, and a second end 42 and 52, respectively. The first brace 40 and the second brace 50 are fixedly mounted to the bottom edge 24 of the first wall member 20 and the bottom edge 34 of the second wall member 30 and are diagonally oriented thereto, The first brace 40 is fixedly mounted at the corner junction 13 adjacent the corner edge 21 of the first wall member 20 and the corner edge 31 of the second wall member 30. The second brace 50 is fixedly mounted parallel to the first brace 40 adjacent the outer edge 22 of the first wall member 20 and the outer edge 32 of the second wall member 30 thereby rigidly interconnecting the first wall member 20 and the second wall member 30 adjacent the outer edges thereof.

The first end 41 of the first brace 40 and the first end 51 of the second brace 50 extend beyond the first wall member 20 so as to form a first first-brace ledge 43 and a first second-brace ledge 53, respectively, for supporting a concrete form 2 placed against the outer surface 26 of the first wall member 20. The second end 42 of the first brace 40 and the second end 52 of the second brace 50 extend beyond the second wall member 30 so as to form a second first-brace ledge 44 and a second second-brace ledge 54, respectively, for supporting a concrete form 2 placed against the outer surface 36 of the second wall member 30. The first brace 40 and the second brace 50 are each trapezoidal shaped wherein the first end 41 of the first brace 40 and the first end 51 of the second brace 50 are generally parallel to the first wall member 20 and wherein the second end 42 of the first brace 40 and the second end 52 of the second brace 50 are generally parallel to the second wall member 30.

As best illustrated in FIGS. 1 through 4, it can be shown that a crossbar 60 is provided for rigidly interconnecting the first wall member 20 and the second wall member 30 adjacent the outer edges thereof. The crossbar 60 has a first end 61 and a second end 62. The first end 61 of the crossbar 60 is fixedly attached to the inner surface 25 of the first wall member 20 adjacent the outer edge 22 thereof and the second end 62 of the crossbar 60 is fixedly attached to the inner surface 35 of the second wall member 30 adjacent the outer edge 32 thereof. The first end 61 of the crossbar 60 is fixedly attached intermediate the top edge 23 of the first wall member 20 and the bottom edge 24 of the first wall member 20 and the second end 62 of the crossbar 60 is fixedly attached intermediate the top edge 33 of the second wall member 30 and the bottom edge 34 of the second wall member 30. As such, the wire mesh screen 3 may be secured to and suspended by the crossbar 60 such that the wire mesh screen 3 becomes embedded within the concrete when poured.

In an illustrative embodiment each of the pair of corner support wall members 12 are 12⅛" long and arc 3¼" wide. In addition, the plurality of holes 27 and 28 comprise three pairs of nailing holes wherein the nailing holes are spaced at 4", 8", and 11" from the corner edges 21 and 31 and are spaced ¾" and 1¾" from the top edges 23 and 33. In the illustrative embodiment each of the pair of cross braces 14 arc 1" wide and the first brace 40 is 4⅛" long along a centerline thereof and the second brace 50 is 15¾" long along a centerline thereof. The pair of cross braces 14 are each oriented at an angle of 45 degrees to the first wall member 20 and the second wall member 30. Each of the pair of corner support wall members 12 and each of the pair of cross braces 14 are formed of 14 gauge steel sheet and the cross bar 60 is formed of 5/16" diameter steel rod.

In use, the pair of corner support wall members 12 are placed on an underlying surface. A first concrete form 2 is placed against the outer surface 26 of the first wall member 20 so as to rest on the first first-brace ledge 43 and the first second-brace ledge 53. A second concrete form 2 is placed against the outer surface 36 of the second wall member 30 so as to rest on the second first-brace ledge 44 and the second second-brace ledge 54. Fasteners 4, more specifically nails, are driven through the plurality of holes 27 and 28 provided in the first wall member 20 and the second wall member 30, respectively, from the inner surfaces thereof and into the concrete forms 2 for securing the concrete forms 2 to the pair of corner support wall members 12. As such, a square corner form is created. Additional concrete forms 2 are laid out and set up using additional Concrete Corner Forms 10 where a square corner form is desired. The wire mesh screen 3 may be secured to and suspended by the crossbar 60 such that the wire mesh screen 3 becomes embedded within the concrete when poured.

After the concrete forms 2 are all laid out and set up, and after the concrete has been poured and allowed to set, the concrete forms 2 are removed from the pair of corner support wall members 12 by prying thereof. Thereafter, the fasteners 4 used for securing the concrete forms 2 to the pair of corner support wall members 12 are cut off near the outer surfaces 26 and 36 of the first wall member 20 and the second wall member 30, respectively. As such, a square corner of concrete is formed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, arc deemed readily apparent and obvious to one skilled in the art, and all equivalent relationships to those illustrated in the drawings and described in the specification arc intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A corner form for use in the setting of concrete, comprising:

a pair of corner support wall members integrally joined at one end and orthogonally oriented relative to one another, each of said pair of corner support wall members having a bottom edge and an outer surface; and a pair of spaced cross braces each fixedly mounted to said bottom edge of each of said pair of corner support wall members and diagonally oriented thereto, at least one of said pair of cross braces extending beyond at least a one of said pair of corner support wall members thereby forming at least one ledge for supporting a concrete form placed against said outer surface of said one of said pair of corner support wall members.

2. The corner form of claim 1, wherein each of said pair of corner support wall members has a plurality of holes therethrough for receiving fasteners.

3. The corner form of claim 1, wherein said pair of corner support wall members comprises:

a first wall member and a second wall member, said first wall member and said second wall member each having a corner edge, an outer edge, a top edge, and a bottom edge, said corner edge of said first wall member and said corner edge of said second wall member integrally joined to form a corner junction, wherein said first wall member is orthogonally oriented relative to said second wall member, said first wall member and said second wall member each having an inner surface and an outer surface.

4. The corner form of claim 3, wherein said pair of cross braces comprises:

a first brace and a second brace, said first brace and said second brace each having a first end and a second end, said first brace and said second brace fixedly mounted to said bottom edge of said first wall member and said bottom edge of said second wall member and diagonally oriented thereto, said first brace fixedly mounted adjacent said corner edge of said first wall member and said corner edge of said second wall member, said second brace fixedly mounted parallel to said first brace adjacent said outer edge of said first wall member and said outer edge of said second wall member.

5. The corner form of claim 4, wherein said first end of said first brace and said first end of said second brace extend beyond said first wall member thereby forming a first first-brace ledge and a first second-brace ledge, said first first-brace ledge and said first second-brace ledge supporting a concrete form placed against said outer surface of said first wall member.

6. The corner form of claim 4, wherein said second end of said first brace and said second end of said second brace extend beyond said second wall member thereby forming a second first-brace ledge and a second second-brace ledge, said second first-brace ledge and a second second-brace ledge supporting a concrete form placed against said outer surface of said second wall member.

7. The corner form of claim 4, wherein said first brace and said second brace are each trapezoidal shaped whereby said first end of said first brace and said first end of said second brace are generally parallel to said first wall member and whereby said second end of said first brace and said second end of said second brace are generally parallel to said second wall member.

8. The corner form of claim 1, further comprising:

a crossbar rigidly interconnecting said pair of corner support wall members at an opposite end thereof and being diagonally oriented thereto.

9. The corner form of claim 3, further comprising:

a crossbar rigidly interconnecting said first wall member and said second wall member adjacent said outer edges thereof.

10. The corner form of claim 9, wherein said crossbar has a first end and a second end, said first end of said crossbar fixedly attached intermediate said top edge of said first wall member and said bottom edge of said first wall member to said inner surface of said first wall member adjacent said outer edge thereof, said second end of said crossbar is fixedly attached intermediate said top edge of said second wall member and said bottom edge of said second wall member to said inner surface of said second wall member adjacent said outer edge thereof.

11. A method of forming a square corner of concrete, comprising the steps of:

(a) providing a corner form including a pair of corner support wall members integrally joined at one end and orthogonally oriented relative to one another, and including a pair of spaced cross braces each fixedly mounted to a bottom edge of each of said pair of corner support wall members and diagonally oriented thereto, wherein each of said pair of cross braces extend beyond each of said pair of corner support wall members thereby forming a first pair of ledges extending beyond a first of said pair of corner support wall members and forming a second pair of ledges extending beyond a second of said pair of corner support wall members;

(b) placing a first concrete form against an outer surface of said first of said pair of corner support wall members and resting said first concrete form on said first pair of ledges;

(c) placing a second concrete form against an outer surface of said second of said pair of corner support wall members and resting said second concrete form on said second pair of ledges;

(d) securing said first concrete form to said first of said pair of corner support wall members;

(e) securing said second concrete form to said second of said pair of corner support wall members;

(f) pouring concrete within said corner form, said first concrete form, and said second concrete form and allowing said poured concrete to set; and (g) removing said first concrete form and said second concrete form from said pair of corner support wall members.

* * * * *